US010527044B2

(12) United States Patent
Humburg et al.

(10) Patent No.: US 10,527,044 B2
(45) Date of Patent: Jan. 7, 2020

(54) SIDE CHANNEL BLOWER, ESPECIALLY FOR A VEHICLE HEATER

(71) Applicant: Eberspächer Climate Control Systems GmbH & Co. KG, Esslingen (DE)

(72) Inventors: Michael Humburg, Göppingen (DE); Hermann Eppler, Balingen (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 239 days.

(21) Appl. No.: 15/607,830

(22) Filed: May 30, 2017

(65) Prior Publication Data

US 2017/0342859 A1 Nov. 30, 2017

(30) Foreign Application Priority Data

May 31, 2016 (DE) ..... 10 2016 109 994

(51) Int. Cl.
*F04D 23/00* (2006.01)
*F04D 29/66* (2006.01)
(Continued)

(52) U.S. Cl.
CPC ..... *F04D 23/008* (2013.01); *F01D 1/00* (2013.01); *F01D 9/02* (2013.01); *F01D 25/24* (2013.01); *F04D 29/403* (2013.01); *F04D 29/663* (2013.01); *F04D 29/665* (2013.01); *F04D 29/667* (2013.01); *F05D 2250/51* (2013.01)

(58) Field of Classification Search
CPC .... F04D 23/008; F04D 29/663; F04D 29/703; F04D 17/16; F04D 29/667; F23D 5/00; B60H 1/2209; B60H 1/2221; B60H 2001/006; F24H 3/065; F24H 1/009; F23M 9/02
See application file for complete search history.

(56) References Cited

U.S. PATENT DOCUMENTS 3,360,193 A * 12/1967 Harris ..... F04D 23/008 415/119
3,375,970 A 4/1968 Gunther
(Continued)

FOREIGN PATENT DOCUMENTS

CN 101319681 A 12/2008
CN 202900799 U 4/2013
(Continued)

*Primary Examiner* — Kenneth J Hansen
(74) *Attorney, Agent, or Firm* — McGlew and Tuttle, P.C.

(57) ABSTRACT

A heater side channel blower includes a blower housing (12) with a bottom wall (14) and a circumferential wall (16), that enclose a first flow chamber in a housing interior (18). A ring-shaped delivery duct (22), open towards an outer side of the blower housing (12), is provided at the bottom wall (14). A flow medium inlet (50), for the entry of medium to be delivered into the housing interior (18), is open towards the first flow chamber. A second flow chamber (42) is provided in the housing interior (18). A flow medium outlet (52), for the discharge of medium to be delivered from the housing interior (18), is open towards the delivery duct (22) to the second flow chamber (42). The first flow chamber is separated from the second flow chamber (42) by at least one chamber separation element (60, 62) that is permeable to medium to be delivered.

18 Claims, 5 Drawing Sheets

(51) Int. Cl.

| | |
|---|---|
| ***F04D 29/40*** | (2006.01) |
| ***F01D 1/00*** | (2006.01) |
| ***F01D 9/02*** | (2006.01) |
| ***F01D 25/24*** | (2006.01) |

(56) References Cited

U.S. PATENT DOCUMENTS

| | | | | |
|---|---|---|---|---|
| 5,603,601 | A | 2/1997 | Winkelstroeter | |
| 2014/0037469 | A1 * | 2/2014 | Humburg | F04D 29/664 417/352 |

FOREIGN PATENT DOCUMENTS

| | | | | |
|---|---|---|---|---|
| DE | 20 21 159 | A1 | 2/1971 | |
| DE | 24 33 094 | A1 | 1/1976 | |
| DE | 40 29 041 | A1 | 4/1991 | |
| DE | 4029041 | A1 * | 4/1991 | F04D 23/008 |
| DE | 43 41 266 | C1 | 7/1994 | |
| DE | 10 2007 060 111 | A1 | 6/2009 | |
| DE | 10 2012 213598 | B3 | 11/2013 | |
| EP | 0718501 | A1 | 6/1996 | |
| EP | 1013936 | B1 | 4/2006 | |
| EP | 2505842 | A1 | 10/2012 | |
| WO | 2006090152 | A1 | 8/2006 | |

* cited by examiner

SIDE CHANNEL BLOWER, ESPECIALLY FOR A VEHICLE HEATER

CROSS REFERENCE TO RELATED APPLICATIONS

This application claims the benefit of priority under 35 U.S.C. § 119 of German Application DE 10 2016 109 994.5 filed May 31, 2016, the entire contents of which are incorporated herein by reference.

FIELD OF THE INVENTION

The present invention pertains to a side channel blower, which may be used, for example, to deliver the air necessary for the combustion with fuel in a vehicle heater in the direction of a combustion chamber.

BACKGROUND OF THE INVENTION

Such a side channel blower is configured basically such that a ring-shaped air delivery duct, which is interrupted in a circumferential area by an interrupter area, is provided at a bottom wall of a blower housing. A flow medium inlet opening, via which the medium being delivered, i.e., for example, air, enters the air delivery duct, and a flow medium outlet opening, via which the medium being delivered leaves the delivery duct, are provided on both sides of the interrupter area. The delivery duct is covered by a delivery wheel, which is carried on a rotor shaft of a blower motor and can be driven by the blower motor for rotation. The delivery wheel has a ring-shaped delivery area, which is adapted to the ring-shaped form of the delivery duct and in which a plurality of delivery blades are provided following one another in the circumferential direction. In the delivery operation, i.e., during rotation of the delivery wheel, the delivery wheels sweep over the interrupter area, i.e., also the area in which the flow medium inlet opening is provided. The noises generated in the process can propagate over a duct, via which the flow medium flowing in the direction of the air delivery duct is being fed, and thus reach the outside area. To muffle these noises, its is generally necessary to arrange an external sound absorber at this duct guiding the flow medium to the flow medium inlet opening.

SUMMARY OF THE INVENTION

An object of the present invention is to provide a side channel blower, especially for a vehicle heater, in which the transportation of noises generated during the delivery operation to the outside is suppressed with a simple configuration.

This object is accomplished according to the present invention by a side channel blower, especially for a vehicle heater, comprising a blower housing with a bottom wall, wherein a ring-shaped delivery duct open towards an outer side of the blower housing is provided at the bottom wall, and with a circumferential wall, wherein the bottom wall and the circumferential wall enclose a housing interior, wherein a first flow chamber is provided in the housing interior, wherein a flow medium inlet for the entry of medium being delivered into the housing interior is open towards the first flow chamber, wherein a second flow chamber is provided in the housing interior, wherein a flow medium outlet for the discharge of medium being delivered from the housing interior to the air delivery duct is open towards the second flow chamber, wherein the first flow chamber is separated from the second flow chamber by means of at least one chamber separation element that is permeable to the medium being delivered.

By providing a plurality of flow chambers through which the medium being delivered flows, it is ensured in a side channel blower configured according to the present invention that noises generated in the area of the delivery duct are effectively muffled by reflection or absorption of sound in the area of the flow chambers through which the flow medium is to flow and thus these cannot essentially reach the outside via the flow medium inlet.

To intensify the effect of sound absorption by reflection or absorption even more in flow chambers through which flow is to take place serially, it is proposed that at least one third flow chamber be provided between the first flow chamber and the second flow chamber, wherein the first flow chamber is separated from a third flow chamber by a chamber separation element, and wherein the second flow chamber is separated from a third flow chamber by a chamber separation element.

A definition of the flow chambers radially inwardly in relation to a housing longitudinal axis can be achieved, for example, by a blower motor extending into the housing interior being carried at the bottom wall, wherein the first flow chamber or/and the second flow chamber, optionally also at least one third flow chamber, is defined by the circumferential wall and a motor housing of the blower motor.

To achieve an effective separation of the flow chambers from one another, it is proposed that at least one and preferably each chamber separation element extend between the circumferential wall and the motor housing. Provisions may be made in this connection, in particular, for at least one and preferably each chamber to adjoin the circumferential wall and the bottom wall and the motor housing and to preferably be in contact with it.

To make it possible to efficiently use the effect of the sound absorption, it is proposed that at least one chamber separation element and preferably each chamber separation element be made with flexible material, preferably foam material.

The possibility of flow through the flow chambers with simultaneous introduction of intensified sound absorption by reflection can be guaranteed by at least one chamber separation element and preferably each chamber separation element having at least one flow medium passage opening, wherein at least one flow medium passage opening preferably has an opening longitudinal axis not oriented at right angles to a housing longitudinal axis or to an axis that is parallel to the housing longitudinal axis.

According to another advantageous aspect, a flow medium duct opening into the first flow chamber at the flow medium inlet may be provided in a side channel blower according to the present invention, wherein the flow medium duct preferably has a duct longitudinal axis that is preferably essentially at right angles and not parallel to a housing longitudinal axis or to an axis extending parallel to the housing longitudinal axis in the area of the opening into the first flow chamber, and wherein the flow medium duct is, furthermore, preferably curved or kinked in an area located upstream of the opening into the first flow chamber. This also contributes to an intensified sound absorption by reflection.

The flow medium inlet is preferably provided at the circumferential wall. The flow medium outlet may be provided, for example, at the bottom wall. If the flow medium inlet and the flow medium outlet are arranged in this manner, an offset of said inlet and outlet in the direction of a housing longitudinal axis is provided, which contributes to the noise absorption based on the flow deflection imposed thereby.

To also close the housing interior on the axial side at a distance from the bottom wall and thus to provide a defined volume, via which the flow medium flows to the delivery duct, it is proposed that the housing interior be closed at an end area of the circumferential wall, facing away from the bottom wall, by an additional bottom wall, preferably provided at a connection/control device housing. This additional bottom wall may also be joined by at least one chamber separation element, preferably each chamber separation element, in order to separate the flow chambers in this area as well.

To couple a blower motor with a delivery wheel, which is to be driven by this for rotation and covers the delivery duct, it is proposed that a rotor shaft of the blower motor pass through an opening in the bottom wall, wherein the delivery wheel covering the air delivery duct is carried at the rotor shaft. Further, provisions may be made, for a constructively simple integration of the blower motor in the blower housing, for a motor housing of a blower motor to be fixed at the bottom wall or to be made integrally in one piece with the bottom wall.

The present invention further pertains to a vehicle heater with a combustion chamber assembly unit and with a side channel blower according to the present invention for delivering combustion air to a combustion chamber of the combustion chamber assembly unit.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
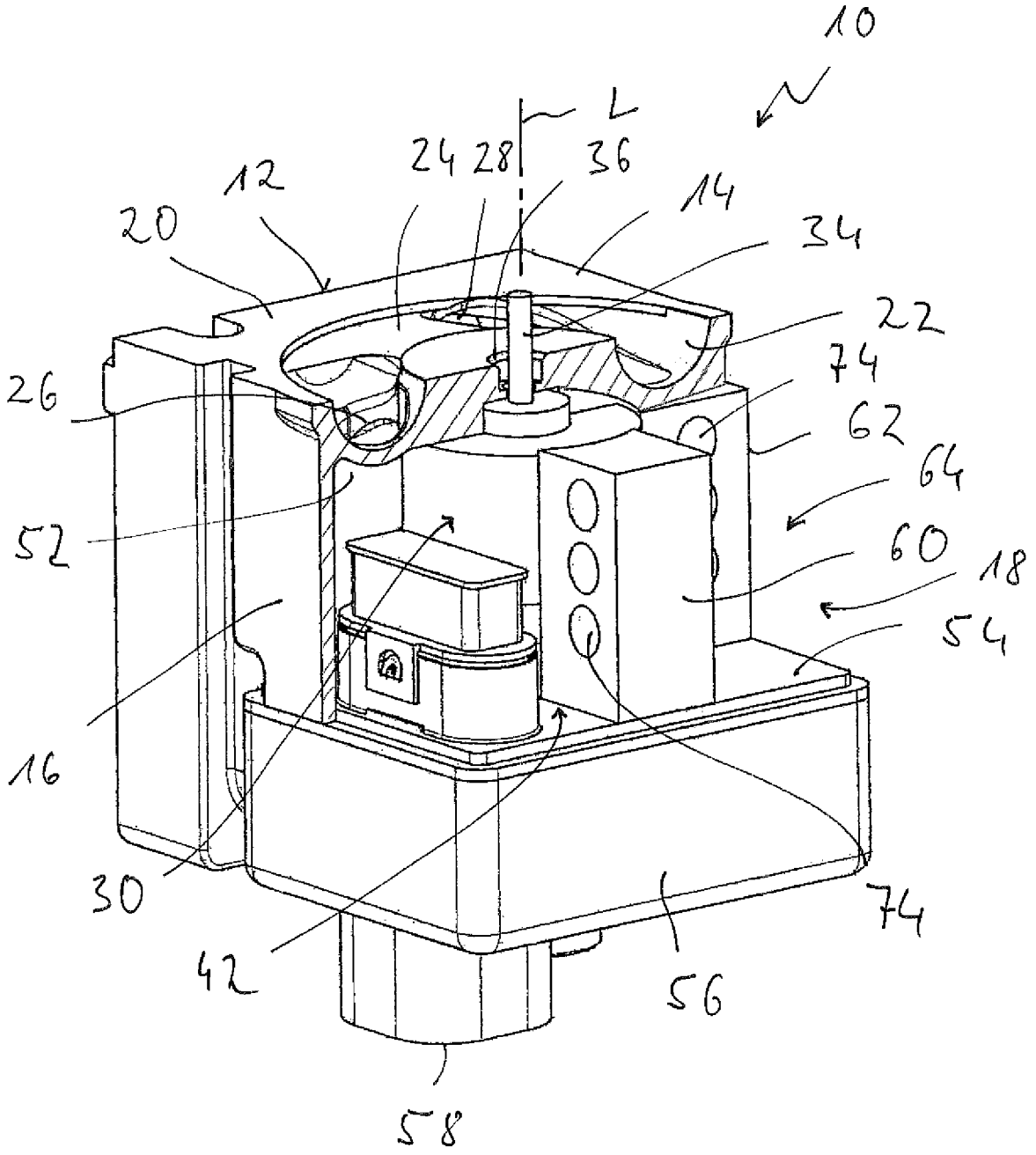
FIG. 1 is a partially sectional, perspective view of a side channel blower with the delivery wheel removed and with the blower housing represented in a section.
Figure 2:
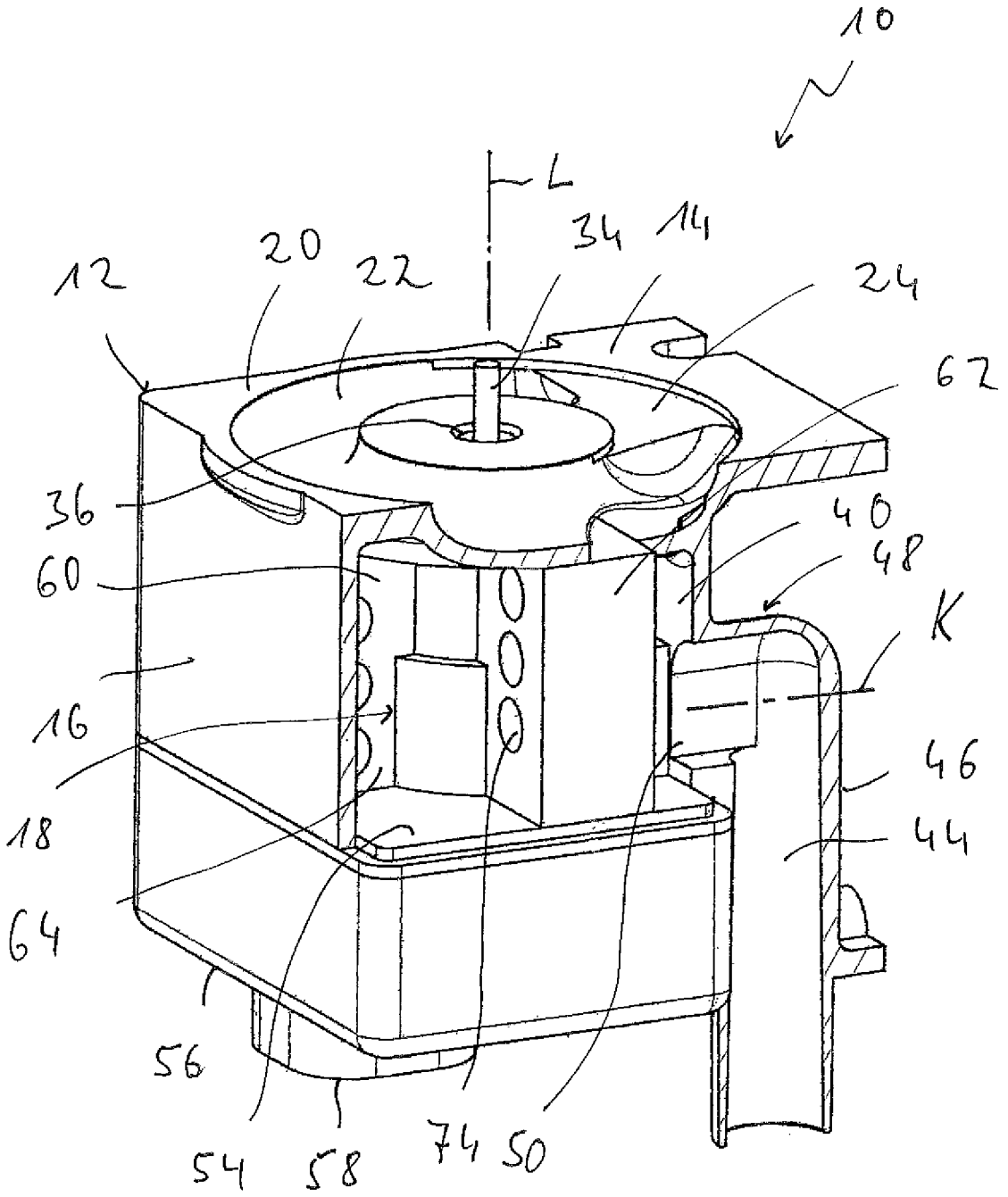
FIG. 2 is a partially sectional, perspective view corresponding to FIG. 1, as viewed from another side.
Figure 3:
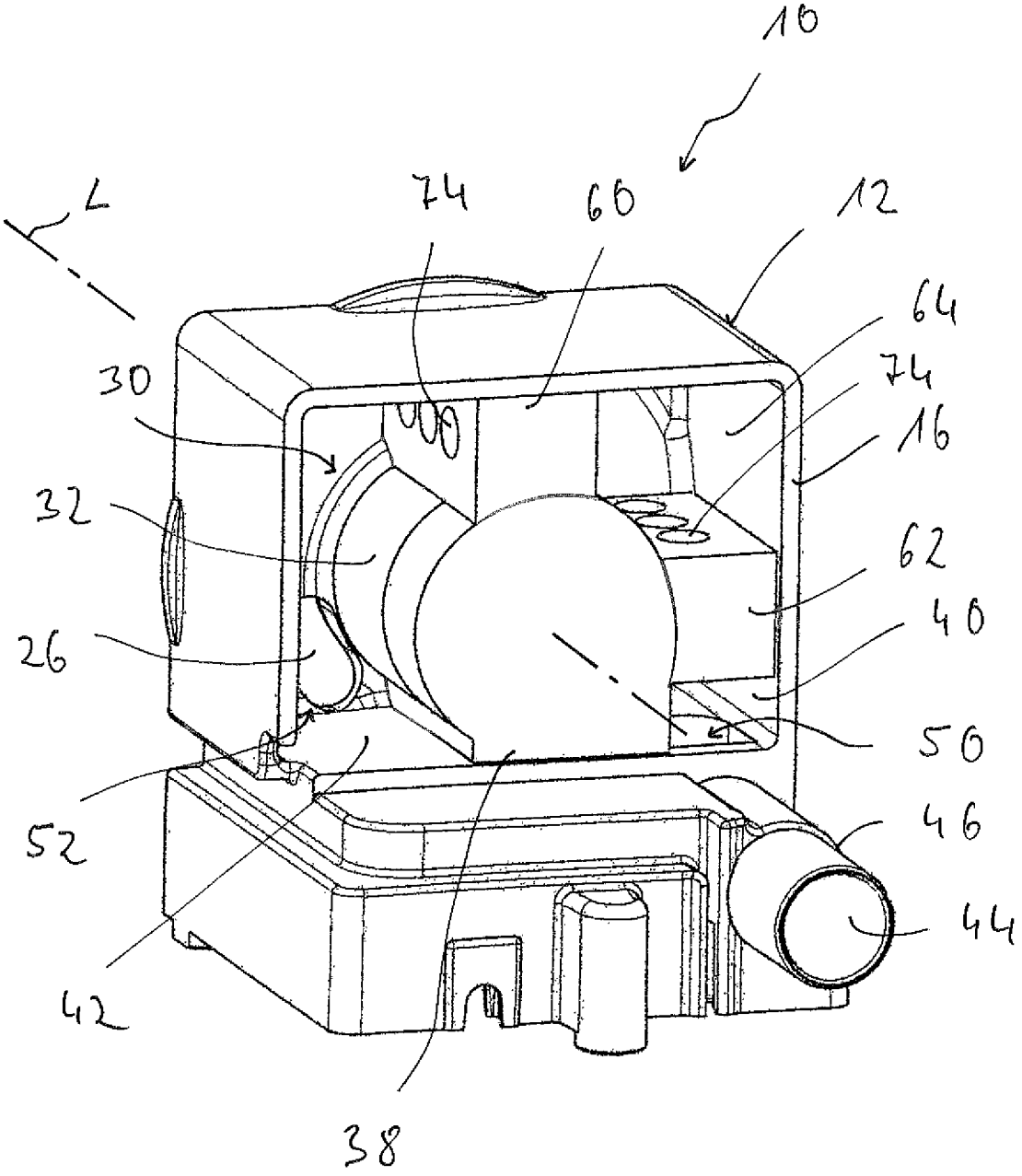
FIG. 3 is a perspective view of a blower housing of the side channel blower according to FIG. 1.

Referring to the drawings, FIGS. 1-4 show in different perspective views a side channel blower 10 and a blower housing 12 of such a side channel blower 10. The blower housing 12 is basically elongated in the direction of a housing longitudinal axis L and has a bottom wall oriented essentially at right angles to the housing longitudinal axis L as well as a circumferential wall 16 adjoining the outer circumferential area of this bottom wall 14 and extending in the direction of the housing longitudinal axis L. The bottom wall 14 and the circumferential wall 16 configured with an essentially rectangular contour define a housing interior 18 of the blower housing 12.

A ring-shaped delivery duct 22 open in the direction of the housing longitudinal axis L is provided at the bottom wall 14 on an outer side 20 facing away from the housing interior 18. The delivery duct 22 is interrupted in the circumferential direction by an interrupter area 24. A flow medium inlet opening 26 leading into the delivery duct 22 is formed in the circumferential direction on a side of the interrupter area 24. A flow medium outlet opening 28 leading out of the delivery duct 22 is provided at the other circumferential end area of the interrupter area 24.

A blower motor 30 is arranged in the housing interior 18. A motor housing 32 of the blower motor 30 may be made integrally in one piece with the bottom wall 14 or fixed thereon, e.g., by screw connection. A stator comprising stator windings as well as a rotor interacting with the stator by magnetic force are provided in the interior of the motor housing 32. A rotor shaft 34 of the blower motor 30 passes through an opening 36 in the bottom wall 14 and thus projects over the outer side 20 of the bottom wall 14. A delivery wheel W, may be coupled with the rotor shaft 34 nonrotatingly in this area of the rotor shaft 34, so that this delivery wheel W rotates, for example, about the housing longitudinal axis L during the rotation operation of the blower motor 30. The delivery wheel W has, in general, a ring-shaped delivery area covering the delivery duct 22 with a plurality of delivery wheels following one another in the circumferential direction about the housing longitudinal axis L.

If the motor housing 32 is configured as an integral part of the bottom wall 14 and hence of blower housing 12, the blower housing 12 may be manufactured in a simple manner as a plastic injection molded part. In a circumferential area, the motor housing 32 may have now a separation area 38, which projects radially outwardly in relation to the housing longitudinal axis L and its otherwise essentially regular cylindrical circumferential contour and extend up to the circumferential wall 16, and adjoin the latter wall by connection in substance in case of integral configuration. A first flow chamber 40 provided in the housing interior 18 and a second flow chamber 42 likewise provided in the housing interior 18 are separated from one another preferably completely by the separation area 38.

A flow medium duct 44 provided for feeding the medium to be delivered, for example, air, is provided in a tubular extension 46, which is formed, for example, likewise integrally with the blower housing 12. In the area in which it has its opening 48 into the first flow chamber 40, the flow medium duct 44 extends with its duct longitudinal axis K essentially at right angles to the housing longitudinal axis L or to an axis which is parallel thereto and opens via a flow medium inlet 50, for example, at least one inlet opening, into the first flow chamber 40. The flow medium duct 44 is kinked essentially at right angles upstream of the opening 48 and extends in the direction away from the opening 48, for example, essentially parallel to the housing longitudinal axis L.

The second flow chamber 42 or the flow medium inlet opening 26 essentially providing the flow medium outlet 52 is open towards the ring-shaped duct 22 in the area of said flow medium outlet 52, which is formed in the bottom wall 14 and is axially offset in relation to the flow medium inlet 50 in the direction of the housing longitudinal axis. The second flow chamber 42 is defined in an axial direction by the bottom wall 14 and is defined in an opposite axial direction by an additional bottom wall 54, which is provided at a connection/control device housing 56 connected to the blower housing 12 in the area of the circumferential wall 16 of said blower housing. A plug connection area 58 may be provided at the connection/control device housing 56 in order to make it possible to couple the blower motor 30 to a vehicle electrical system for energy supply. Further, a control device associated with the side channel blower 10 or the blower motor 30 may be provided in the connection/control device housing 56 in order to make it possible to actuate the blower motor 30 in a suitable manner for carrying out the delivery operation. The second flow chamber 42 is defined in the circumferential direction by the circumferential wall 16, the motor housing 32, especially the separation area 38 thereof, and a chamber separation element 60 yet to be explained in detail below.

The first flow chamber 40 is also defined in the two axial directions in relation to the housing longitudinal axis L by the bottom wall 14, on the one hand, and the additional bottom wall 54 of the connection/control device housing 56, on the other hand. The first flow chamber 40 is defined in the circumferential direction by the circumferential wall 16, the motor housing 32, especially the separation area 38 thereof, and an additional chamber separation element 62.

The two chamber separation elements 60, 62 are arranged at spaced locations from one another, for example, at an angular distance of about 90°, in the circumferential direction in relation to the housing longitudinal axis L. A third flow chamber 64 is formed between the two chamber separation elements 60, 62. The third flow chamber 64 is thus defined in both axial directions between the bottom walls 14, 54 in relation to the housing longitudinal axis L and by the two chamber separation elements 60, 62, the circumferential wall 16 of the blower housing 12 and the motor housing the circumferential direction.

Figure 4:
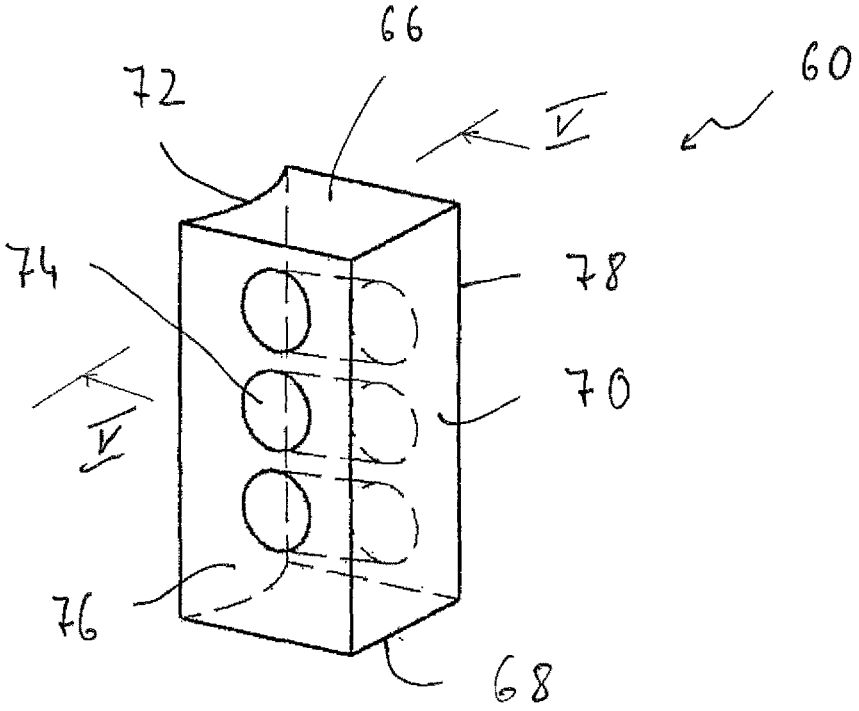
FIG. 4 is a perspective view of a chamber separation element of the side channel blower according to FIG. 1.
Figure 5:
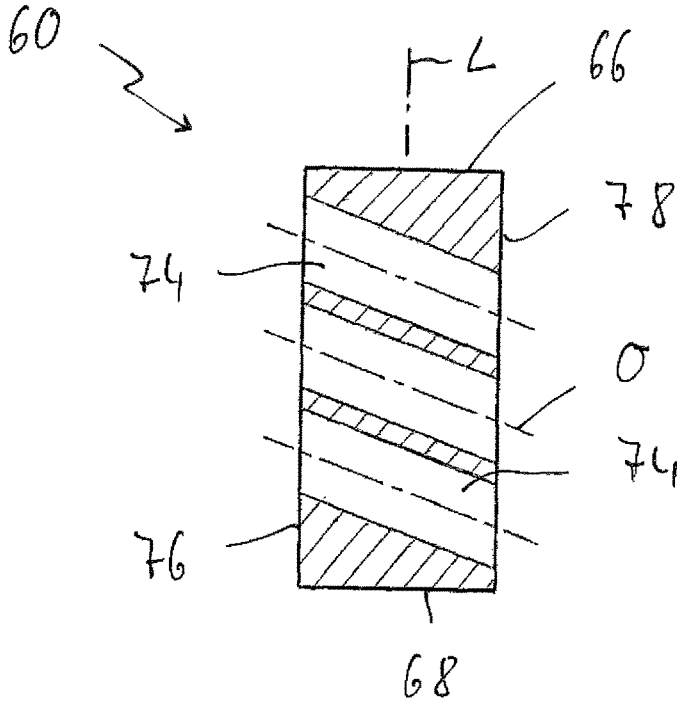
FIG. 5 is a sectional view of the chamber separation element according to FIG. 4, cut along a line V-V in FIG. 4.

FIGS. 4 and 5 show the configuration of the two chamber separation elements 60, 62 as an example on the basis of the chamber separation element 60. The chamber separation element 60 has an essentially cuboid configuration and is manufactured, for example, from flexible, sound-absorbing material, for example, foam material. Based on its flexibility, the chamber separation element 60 may be arranged in contact under pressure between the circumferential wall 16 and the motor housing 32 and the two bottom walls 14, 54, so that it is in contact with the respective walls under pressure and is thus held in a stable manner, on the one hand, and prevents the flow of medium being delivered in the connection area to the different walls, on the other hand. To obtain the flat contact in these contact areas, the chamber separation element 60 is made essentially flat on its two front sides 66, 68 in adaptation to the contour of the two bottom walls 14, 54. The circumferential side 70 intended for contact with the circumferential wall 16 also has an essentially flat configuration in this contact area corresponding to the essential flat shape of the circumferential wall 16 in this contact area. The circumferential side 72 intended for being in contact with the motor housing 32 is configured with an essentially circular concave shape in adaptation to the circular circumferential contour of the motor housing.

To make possible the passage of the flow medium, the chamber separation element 60 has a plurality of flow medium passage openings 74, which extend in the chamber separation element 60 between the two circumferential sides 76, 78 facing the second flow chamber 42 and the third flow chamber 64, for example, essentially a straight line along a respective opening longitudinal axis O. For example, the flow medium passage openings 74 extend essentially parallel to one another not at right angles in relation to the housing longitudinal axis L or an axis parallel thereto and also not parallel, i.e., at an angle different from 90° or 180°.

The medium being delivered through the side channel blower 10 is drawn in during the rotation operation of the delivery wheel W via the flow medium duct 44 and thus it reaches the first flow chamber 40 via the flow medium inlet 50. The medium to be delivered flows from the first flow chamber 40 through the chamber separation element 62 and the flow medium passage openings 74 formed therein into the third flow chamber 64. The medium to be delivered enters the second flow chamber 42 from the third flow chamber 64 through the flow medium passage openings 74 of the chamber separation element 60. The medium to be delivered flows via the flow medium outlet 52 or the flow medium inlet opening 26 into the delivery duct 22 close to the interrupter area 24.

The medium to be delivered is thus deflected multiple times in its flow direction over its flow path from the flow medium duct 44 to the ring-shaped duct 22. Such a flow deflection takes place already before the entry into the first flow channel 40, it takes place at the time of entry into the flow medium passage openings 74 of the chamber separation element 62 and also at the time of discharge from these; it takes place, furthermore, at the time of entry into the flow medium passage openings 74 of the chamber separation element 60 and at the time of discharge from these, and it takes place finally at the time of discharge from the second flow chamber 42 into the delivery duct 22. Based on this multiple deflection of the flow of the medium being delivered over its flow path to the ring-shaped duct 22, direct exit of the sound generated in the area of the interrupter area 24 over the flow path of the medium being delivered is not possible. Based on the multiple reflections to the walls defining different flow chambers, which occur in the flow path, and also based on the absorption especially on the chamber separation elements 60, 62, efficient noise muffling is achieved, so that propagation of the noises generated especially in the area of the interrupter area 24 during the rotation operation of the delivery wheel W over the flow path of the medium being delivered to the ring-shaped duct 22 is extensively prevented.

It should be noted that this muffling of noises generated during the variation of the side channel blower 10, which is achieved according to the present invention, can also be achieved in a variant of the side channel blower 10 shown in the figures, while the principles of the present invention are maintained. For example, it may be possible not to provide the third flow chamber, so that only the first flow chamber 40 and the second flow chamber 42 and a chamber separation element directly separating these two from one another as well as also the separation area 38 are provided. It would also be possible to provide a plurality of third flow chambers 64 following each other in series between the first flow chamber 40 and the second flow chamber 42. The chamber separation elements 60, 62 could be inserted into the blower housing 12 to intensify the deflection effect such that the respective flow medium passage openings 74 being provided therein are bent opposite in relation to the housing longitudinal axis L. While the configuration of the chamber separation elements 60, 62 as separate components and thus making them from a material that may differ from the material of the blower housing 12 for an intensified absorption and muffling effect are especially advantageous, it would also be possible, in principle, to make the chamber separation elements integrally in one piece with the lower housing by connection in substance in contact with the circumferential wall 16 and the motor housing 32 as well as the bottom wall 14. To intensify the sound absorption effect even more, the inner surface of the blower housing could be structured, for example, roughened, or layers made of sound-absorbing material, for example, foam material, could be provided on the inner surface of the blower housing.

Figure 6:
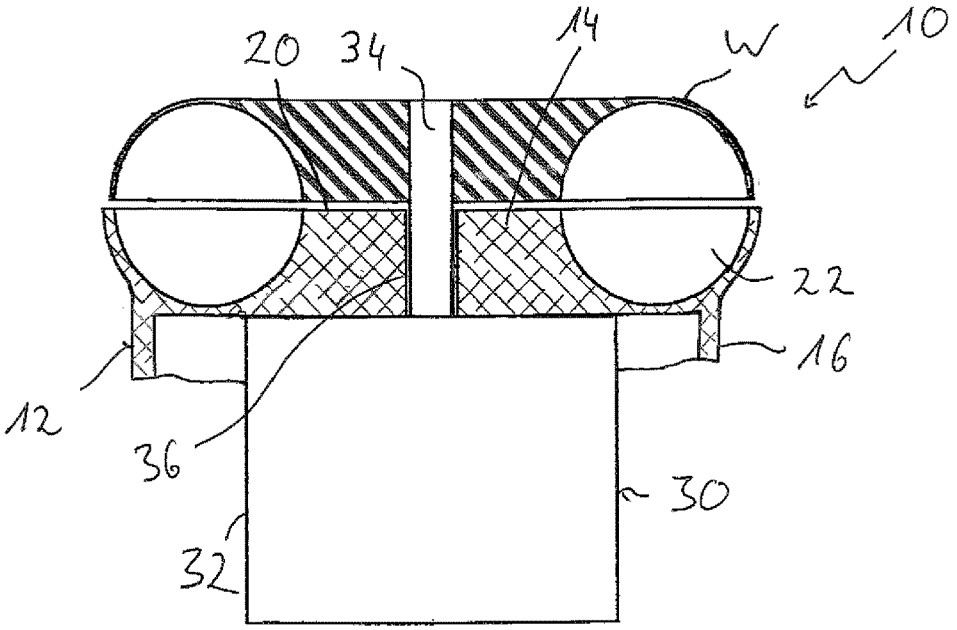
FIG. 6 is a sectional view showing a portion of the side channel blower in which a delivery wheel is attached to the rotor shaft.
Figure 7:
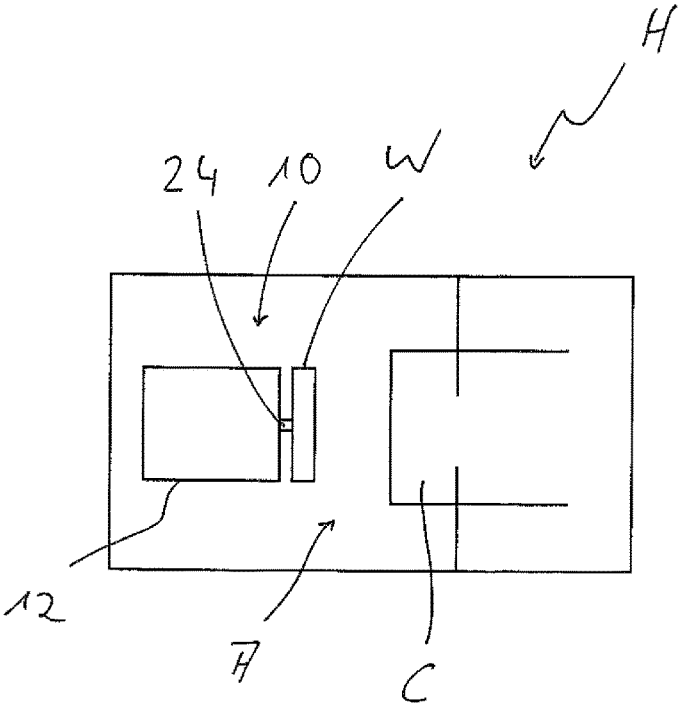
FIG. 7 is a schematic view showing the vehicle heater with the side channel blower, including a blower housing and a delivery wheel as well as a combustion chamber assembly unit having a combustion chamber.

FIG. 6 shows a portion of the side channel blower 10 in which the delivery wheel W is attached to the rotor shaft 34. As shown in FIG. 7, the side channel blower 10, with the blower housing 12 and the delivery wheel W, may be a part of a vehicle heater H. The vehicle heater H also includes a combustion chamber assembly unit A having a combustion chamber C. The side channel blower 10 delivers combustion air to the combustion chamber C of the combustion chamber assembly unit A.

While specific embodiments of the invention have been shown and described in detail to illustrate the application of the principles of the invention, it will be understood that the invention may be embodied otherwise without departing from such principles.

What is claimed is:

1. A side channel blower, for a vehicle heater, the side channel blower comprising:

a blower housing comprising: a bottom wall with a ring-shaped air delivery duct surrounding a housing longitudinal axis and open towards an outer side of the blower housing; and a circumferential wall, wherein the bottom wall and the circumferential wall enclose a housing interior;

a first flow chamber provided in the housing interior;

a flow medium inlet open to the first flow chamber for the entry of medium being delivered into the housing interior;

a second flow chamber provided in the housing interior downstream of the first flow chamber and upstream of the air delivery duct;

a flow medium outlet open to the second flow chamber for the discharge of medium being delivered from the housing interior to the air delivery duct;

a blower motor extending into the housing interior and carried at the bottom wall, wherein the blower motor comprises a motor housing and each of the first flow chamber and the second flow chamber is at least partially defined by the circumferential wall and the motor housing of the blower motor; and at least one chamber separation element permeable to medium being delivered, wherein the at least one chamber separation element extends between and is supported by the circumferential wall and the motor housing and the first flow chamber is separated from the second flow chamber by the at least one chamber separation element.

2. A side channel blower in accordance with claim 1, further comprising:

at least one third flow chamber between the first flow chamber and the second flow chamber; and at least another chamber separation element, wherein the first flow chamber is separated by the at least another chamber separation element from the third flow chamber and the second flow chamber is separated by the at least one chamber separation element from the third flow chamber.

3. A side channel blower in accordance with claim 1, wherein the at least one chamber separation element adjoins the circumferential wall and the bottom wall and is in contact with the circumferential wall and the bottom wall.

4. A side channel blower in accordance with claim 1, wherein the at least one chamber separation element is made from a flexible foam material.

5. A side channel blower in accordance with claim 1, wherein the at least one chamber separation element has at least one flow medium passage opening having a flow medium passage opening longitudinal axis not oriented at right angles to the housing longitudinal axis or not oriented at right angles to an axis that is parallel to the housing longitudinal axis.

6. A side channel blower in accordance with claim 1, further comprising a flow medium duct wherein:

the flow medium duct opens into the first flow chamber and leads to the flow medium inlet;

the flow medium duct has a flow medium duct portion opening into the first flow chamber with a flow medium duct portion longitudinal axis, which extends essentially at right angles to and is not parallel to the housing longitudinal axis or extends essentially at right angles to and is not parallel to an axis that is parallel to the housing longitudinal axis; and the flow medium duct is curved or kinked in an area located upstream of the flow medium duct portion opening into the first flow chamber.

7. A side channel blower in accordance with claim 1, wherein the flow medium inlet is provided at the circumferential wall or the flow medium outlet is provided at the bottom wall or the flow medium inlet is provided at the circumferential wall and the flow medium outlet is provided at the bottom wall.

8. A side channel blower in accordance with claim 1, further comprising an additional bottom wall, wherein:

the housing interior is closed by the additional bottom wall;

the additional bottom wall is provided at a connection/control device housing, at an end area of the circumferential wall, which said end area faces away from the bottom wall; and the at least one chamber separation element adjoins the additional bottom wall.

9. A side channel blower in accordance with claim 1, wherein:

a rotor shaft of the blower motor passes through an opening in the bottom wall;

a delivery wheel, covering the air delivery duct, is carried on the rotor shaft; and the motor housing of the blower motor is secured on the bottom wall or is made integrally in one piece with same.

10. A vehicle heater comprising a combustion chamber assembly unit and a side channel blower for delivering combustion air to a combustion chamber of the combustion chamber assembly unit, the side channel blower comprising:

a blower housing comprising: a bottom wall with a ring-shaped air delivery duct surrounding a housing longitudinal axis and open towards an outer side of the blower housing; and a circumferential wall, wherein the bottom wall and the circumferential wall enclose a housing interior;

a first flow chamber provided in the housing interior;

a flow medium inlet open to the first flow chamber for the entry of medium being delivered into the housing interior;

a second flow chamber provided in the housing interior downstream of the first flow chamber and upstream of the air delivery duct;

a flow medium outlet open to the second flow chamber for the discharge of medium being delivered from the housing interior to the air delivery duct;

a blower motor extending into the housing interior and carried at the bottom wall, wherein the blower motor comprises a motor housing and each of the first flow chamber and the second flow chamber is at least partially defined by the circumferential wall and the motor housing of the blower motor; and at least one chamber separation element permeable to medium being delivered, wherein the at least one chamber separation element extends between and is supported by the circumferential wall and the motor housing and the first flow chamber is separated from the second flow chamber by the at least one chamber separation element.

11. A vehicle heater in accordance with claim 10, wherein the side channel blower further comprises:

at least one third flow chamber between the first flow chamber and the second flow chamber; and at least another chamber separation element, wherein the first flow chamber is separated by the at least another chamber separation element from the third flow chamber and the second flow chamber is separated by the at least one chamber separation element from the third flow chamber.

12. A vehicle heater in accordance with claim 10, wherein:

the at least one chamber separation element adjoins the circumferential wall and the bottom wall and is in contact with the circumferential wall and the bottom wall.

13. A vehicle heater in accordance with claim 10, wherein the at least one chamber separation element is made from a flexible foam material.

14. A vehicle heater in accordance with claim 10, wherein the at least one chamber separation element has at least one flow medium passage opening having a flow medium passage opening longitudinal axis not oriented at right angles to the housing longitudinal axis or not oriented at right angles to an axis that is parallel to the housing longitudinal axis.

15. A vehicle heater in accordance with claim 10, wherein the side channel blower further comprises a flow medium duct, wherein:

the flow medium duct opens into the first flow chamber and leads to the flow medium inlet;

the flow medium duct has a flow medium duct portion opening into the first flow chamber with a flow medium duct portion longitudinal axis, which extends essentially at right angles to and is not parallel to the housing longitudinal axis or extends essentially at right angles to and is not parallel to an axis that is parallel to the housing longitudinal axis; and the flow medium duct is curved or kinked in an area located upstream of the flow medium duct opening into the first flow chamber.

16. A vehicle heater in accordance with claim 10, wherein the flow medium inlet is provided at the circumferential wall or the flow medium outlet is provided at the bottom wall or the flow medium inlet is provided at the circumferential wall and the flow medium outlet is provided at the bottom wall.

17. A vehicle heater in accordance with claim 10, further comprising an additional bottom wall, wherein:

the housing interior is closed by the additional bottom wall;

the additional bottom wall is provided at a connection/control device housing, at an end area of the circumferential wall, which said end area faces away from the bottom wall; and the at least one chamber separation element adjoins the additional bottom wall.

18. A vehicle heater in accordance with claim 14, wherein:

a rotor shaft of the blower motor passes through an opening in the bottom wall;

a delivery wheel, covering the air delivery duct, is carried on the rotor shaft; and the motor housing of the blower motor is secured on the bottom wall or is made integrally in one piece with same.

* * * * *